US010001256B2

(12) United States Patent
Cai et al.

(10) Patent No.: US 10,001,256 B2
(45) Date of Patent: Jun. 19, 2018

(54) STRUCTURES SUBJECTED TO THERMAL ENERGY AND THERMAL MANAGEMENT METHODS THEREFOR

(71) Applicant: GE Lighting Solutions, LLC, East Cleveland, OH (US)

(72) Inventors: Dengke Cai, Mayfield Heights, OH (US); Gary Robert Allen, Chesterland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 701 days.

(21) Appl. No.: 14/567,270

(22) Filed: Dec. 11, 2014

(65) Prior Publication Data

US 2016/0169500 A1 Jun. 16, 2016

(51) Int. Cl.

| | |
|---|---|
| ***F21V 29/87*** | (2015.01) |
| ***F21V 3/04*** | (2018.01) |
| ***F21K 9/66*** | (2016.01) |
| *F21Y 115/10* | (2016.01) |
| *F21K 9/232* | (2016.01) |

(52) U.S. Cl.

CPC ..... *F21V 3/0445* (2013.01); *F21K 9/66* (2016.08); *F21V 3/0625* (2018.02); *F21K 9/232* (2016.08); *F21Y 2115/10* (2016.08)

(58) Field of Classification Search

CPC ..... F21V 3/0445; F21V 29/87; F21K 9/66; F21K 9/232; F21Y 2115/10

USPC ..... 442/59; 362/394

See application file for complete search history.

(56) References Cited

U.S. PATENT DOCUMENTS

| | | | |
|---|---|---|---|
| 2004/0190305 | A1 | 9/2004 | Arik |
| 2011/0169394 | A1 | 7/2011 | Chowdhury |
| 2011/0242817 | A1 | 10/2011 | Chowdhury |
| 2012/0098425 | A1 | 10/2012 | Arik |

*Primary Examiner* — Vincent A Tatesure

(74) *Attorney, Agent, or Firm* — Peter T. DiMauro; GE Global Patent Operation

(57) ABSTRACT

Thermal management approaches and methods for structures requiring certain optical and thermal properties, for example, components of LED-based lighting units. Such a structure is in thermal communication with a source of visible light and thermal energy, and visible light emitted by the source passes through the structure. The structure includes a portion formed of a composite material containing a polymeric matrix material and a fiber material that contributes an optical scattering effect to the visible light passing through the composite material. The fiber material is made up of individual fibers that each comprise a core material and an opaque diffusive white coating on an external surface thereof. The fiber material and its coating contribute to the thermal conductivity and an optical scattering effect of the composite material.

8 Claims, 2 Drawing Sheets

STRUCTURES SUBJECTED TO THERMAL ENERGY AND THERMAL MANAGEMENT METHODS THEREFOR

BACKGROUND OF THE INVENTION

The present invention generally relates to thermal management of structures subjected to thermal energy, nonlimiting examples of which include lighting units that utilize one or more light-emitting diodes (LEDs) as a light source.

BACKGROUND OF THE INVENTION

As known in the art, LEDs (which as used herein also encompasses organic LEDs, or OLEDs) are solid-state semiconductor devices that convert electrical energy into electromagnetic radiation that includes visible light (wavelengths of about 400 to 750 nm). An LED typically comprises a chip (die) of a semiconducting material doped with impurities to create a p-n junction. The LED chip is electrically connected to an anode and cathode, all of which are often mounted within a package. Lamps (bulbs) that utilize LED technology provide a variety of advantages over more traditional incandescent and fluorescent lamps, including but not limited to a longer life expectancy, high energy efficiency, and full brightness without requiring time to warm up. Because, in comparison to other lamps such as incandescent or fluorescent lamps, LEDs emit visible light that is more directional in a narrower beam, LED-based lamps have traditionally been utilized in applications such as automotive, display, safety/emergency, and directed area lighting. However, advances in LED technology have enabled high-efficiency LED-based lighting systems to find wider use in lighting applications that have traditionally employed other types of lighting sources, including omnidirectional lighting applications previously served by incandescent and fluorescent lamps. As a result, LEDs are increasingly being used for area lighting applications in residential, commercial and municipal settings.

FIG. 1 represents a nonlimiting commercial example of an LED-based lighting unit suitable for area lighting applications. The lighting unit (hereinafter, lamp) 10 is represented as a General Electric Energy Smart LED bulb or lamp (ANSI A19 type) configured to provide a nearly omnidirectional lighting capability. LED-based lighting units of various other configurations are also known. As represented in FIG. 1, the lamp 10 comprises a transparent or translucent cover or enclosure 12, an Edison-type threaded base connector 14, a housing or base 16 between the enclosure 12 and the connector 14, and heat-dissipating fins 18 that enhance radiative and convective heat transfer from the base 16 and enclosure 12 to the surrounding environment.

An LED-based light source, often an LED array comprising multiple LEDs, is typically located at the lower end of the enclosure 12 adjacent the base 16. Because LEDs emit visible light in narrow bands of wavelengths, for example, green, blue, red, etc., combinations of different LEDs are often combined in LED lamps to produce various light colors, including white light. The LEDs may be mounted on a carrier mounted to or within the base 16, and may be encapsulated on the carrier, for example, with a protective cover, often formed of an index-matching material to enhance the efficiency of visible light extraction from the LEDs. As a nonlimiting example, FIG. 2 represents a portion of an LED device 20 of a type that comprises a dome 22 that serves as an optically transparent or translucent envelope enclosing an LED chip 24 mounted on a printed circuit board (PCB) 26. A phosphor may also be used to emit light of color other than what is generated by an LED. For this purpose, the inner surface of the dome 22 may be provided with a coating 28 that contains a phosphor composition, in which case electromagnetic radiation (for example, blue visible light, ultraviolet (UV) radiation, or near-visible ultraviolet (NUV) radiation) emitted by the LED chip 24 can be absorbed by the phosphor composition, resulting in excitation of the phosphor composition to produce visible light that is emitted through the dome 22. As an alternative, the LED chip 24 may be encapsulated on the PCB 26 with a coating, and such a coating may optionally contain a phosphor composition for embodiments in which LED-phosphor integration with LED epitaxial (epi) wafer or die fabrication is desired.

To promote the capability of the lamp 10 to emit visible light in a nearly omnidirectional manner, the enclosure 12 is represented in FIG. 1 as substantially ellipsoidal or spheroidal in shape. To further promote a near omnidirectional lighting capability, the enclosure 12 can be formed of a material that enables the enclosure 12 to function as an optical diffuser. As a nonlimiting example, the enclosure 12 may be or may include an assembly comprising a pair of semi-elliptical or semispherical diffusers between which an internal reflector (not shown) may be disposed, such that visible light generated by the LED devices is directed into the interior of the enclosure 12, a portion of the generated light is reflected by the reflector into the diffuser nearer the base 16, through which the reflected light is distributed to the environment surrounding the lamp 10. The remainder of the generated light passes through an opening in the reflector and enters the second diffuser, through which the passed light is distributed to the environment surrounding the lamp 10. Materials commonly employed to produce the enclosure 12 include polyamides (nylon), polycarbonate (PC), polystyrene (PS), and polypropylene (PP) that typically contain a filler, for example, titania ($TiO_2$) to promote refraction of the light and thereby achieve a white reflective appearance. The inner surface of the enclosure 12 may be provided with a coating (not shown), for example, a coating that contains a phosphor composition.

Area lighting applications typically require significantly higher electrical power levels for LED-based light units (such as of the type represented in FIG. 1) to produce greater amounts of light. A portion of the electrical power is converted into heat, which is preferably dissipated from the LED to promote the efficiency and reliability of the LEDs. While incandescent and fluorescent lamps typically dissipate a significant amount of heat, e.g., via radiation through the lens of the lamp, this approach has often been found to be inadequate for use in high power LED-based lighting units of types suitable for area lighting applications. Consequently, high power LED-based lighting units are often designed to dissipate heat via conduction by directly attaching the LED chip/package to a substrate capable of serving as a heat sink, and/or via convection and radiation with fins (e.g., 18 in FIG. 1) located externally of the LEDs. Nonlimiting examples of advanced fin and heat sink designs and materials are disclosed, respectively, in U.S. Patent Application Publication Nos. 2011/0169394 and 2011/0242817, each of which discloses the use of a polymer composite comprising a carbon nanotube filler in a polymer matrix. Various other thermal management techniques have also been proposed, such as active cooling techniques, nonlimiting examples of which are disclosed U.S. Patent Application Publication Nos. 2004/0190305 and 2012/0098425. While effective, thermal management systems can present a number of design challenges, particularly in view of the compact and lightweight designs typically desired for lighting units.

BRIEF DESCRIPTION OF THE INVENTION

The present invention provides thermal management approaches and methods for structures requiring certain optical properties, for example, components of LED-based lighting units.

According to one aspect of the invention, a structure is in thermal communication with a source of visible light and thermal energy, and visible light emitted by the source passes through the structure. The structure includes a portion formed of a composite material comprising a polymeric matrix material and a fiber material that contributes an optical scattering effect to the visible light passing through the composite material. The polymeric matrix material is transparent or translucent to the visible light of the source, and the fiber material causes the composite material to have a thermal conductivity greater than that of the polymeric matrix material. The fiber material comprises individual fibers that each comprise a core material. Individual fibers further have an opaque diffusive white coating on an external surface of their core material. The coating causes external surfaces of the individual fibers to have higher optical reflectivities than the core material, and the fiber material and its coating contribute to an optical scattering effect of the composite material and the portion of the structure formed thereof.

According to another aspect of the invention, an LED-based lighting unit includes an enclosure comprising a translucent diffuser portion. At least one LED device emits visible light through the diffuser portion, generates thermal energy, and is in thermal communication with the diffuser portion. The diffuser portion is formed of a composite material comprising a polymeric matrix material and a fiber material that contributes an optical scattering effect to the visible light passing through the diffuser portion. The polymeric matrix material is transparent or translucent to the visible light of the LED device, and the fiber material causes the composite material to have a thermal conductivity greater than that of the polymeric matrix material. The fiber material comprises individual fibers that each comprise a core material. Individual fibers further have an opaque diffusive white coating on an external surface of their core material. The coating causes external surfaces of the individual fibers to have higher optical reflectivities than the core material, and the fiber material and its coating contribute to an optical scattering effect of the composite material and the diffuser portion formed thereof.

According to yet another aspect of the invention, a method is provided for thermal management of an LED-based lighting unit. The method includes providing a fiber material comprising individual fibers that each comprise a core material and an opaque diffusive white coating on an external surface thereof, wherein the coating causes external surfaces of the individual fibers to have higher optical reflectivities than the core material. A portion of the structure is then formed of a composite material comprising a polymeric matrix material and the fiber material, wherein the fiber material causes the composite material to have a thermal conductivity greater than that of the polymeric matrix material. Visible light and heat are then generated with the source so that the visible light passes through the structure and the fiber material contributes an optical scattering effect to the visible light passing through the composite material.

A technical effect of the invention is the ability of the composite material to have a sufficient thermal conductivity to promote heat transfer from the source of visible light and thermal energy, while also providing an optical scattering effect to promote a near omnidirectional lighting capability for a lighting unit.

Other aspects and advantages of this invention will be better appreciated from the following detailed description.

DETAILED DESCRIPTION OF THE INVENTION

Figure 1:
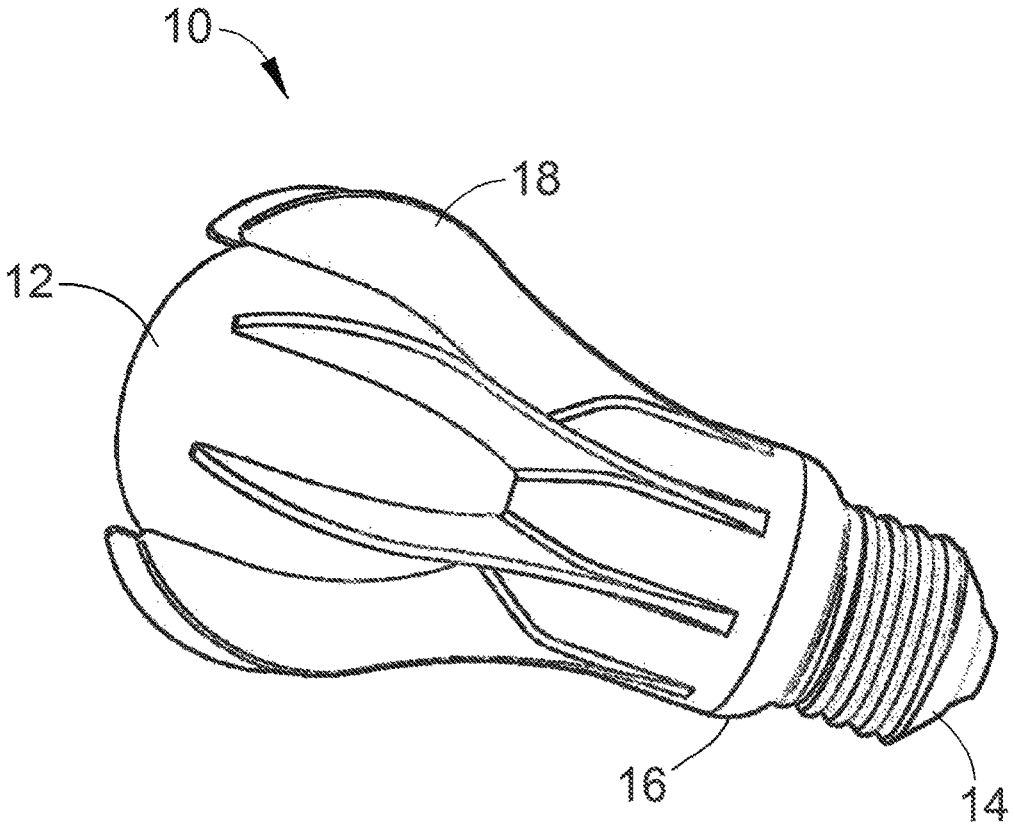
FIG. 1 represents an LED-based lighting unit of a type capable of benefitting from the inclusion of thermally-conducting translucent materials of types disclosed in accordance with nonlimiting embodiments of this invention.
Figure 2:
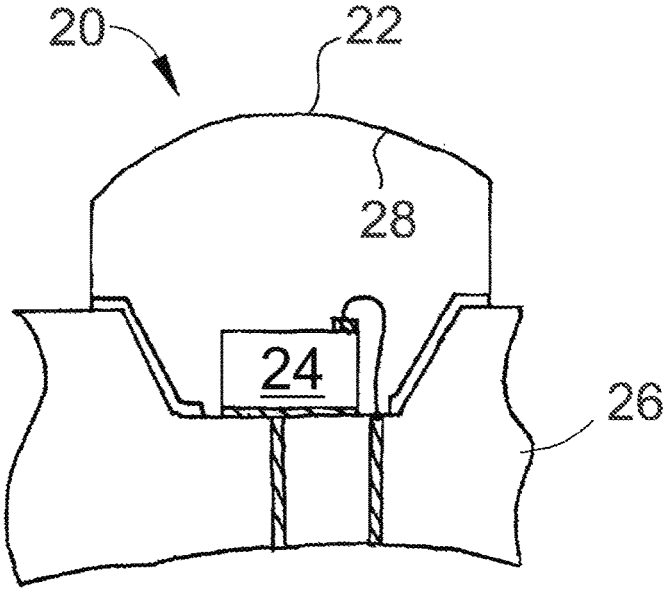
FIG. 2 represents a fragmentary cross-sectional view of an LED device of a type capable of use in an LED-based lighting unit, for example, of the type represented in FIG. 1.

The following discussion will make reference to the LED-based lamp 10 and LED device 20 represented in FIGS. 1 and 2. However, it should be appreciated that lighting units and LED devices of various other configurations are also within the scope of the invention.

As previously discussed in reference to FIG. 1, the lamp 10 is represented as a General Electric Energy Smart LED A19 bulb or lamp configured to provide a nearly omnidirectional lighting capability. The lamp 10 comprises an enclosure 12, an Edison-type threaded base connector 14, a housing or base 16 between the enclosure 12 and the connector 14, and heat-dissipating fins 18 that conduct heat from the base 16 and enhance radiative and convective heat transfer to the surrounding environment. As previously discussed in reference to FIG. 2, the LED device 20 typically comprises multiple LED chips and may be located within the base 16 in proximity to the enclosure 12. For example, FIG. 2 depicts the LED device 20 as mounted on a PCB (or other suitable carrier) 26 typically located in a cavity within the base 16. In preferred embodiments of the invention, the LED device 20 is encapsulated on the PCB 26, for example, with a dome 22 formed of an index-matching polymer to enhance the efficiency of visible light extraction from the LED device 20. The base 16 typically contains driving electronics (not shown) and preferably also a heatsink on which the PCB 26 and LED device 20 may be mounted for the purpose of conducting heat from the LED device 20 to the fins 18. As known in the art, the driving electronics are adapted to convert A.C. power received at the connector 14 to a form suitable for driving the LED device 20, though it is foreseeable that this function could be omitted if the LED device 20 is configured to be operated directly from the power received at the connector 14.

Figure 3:
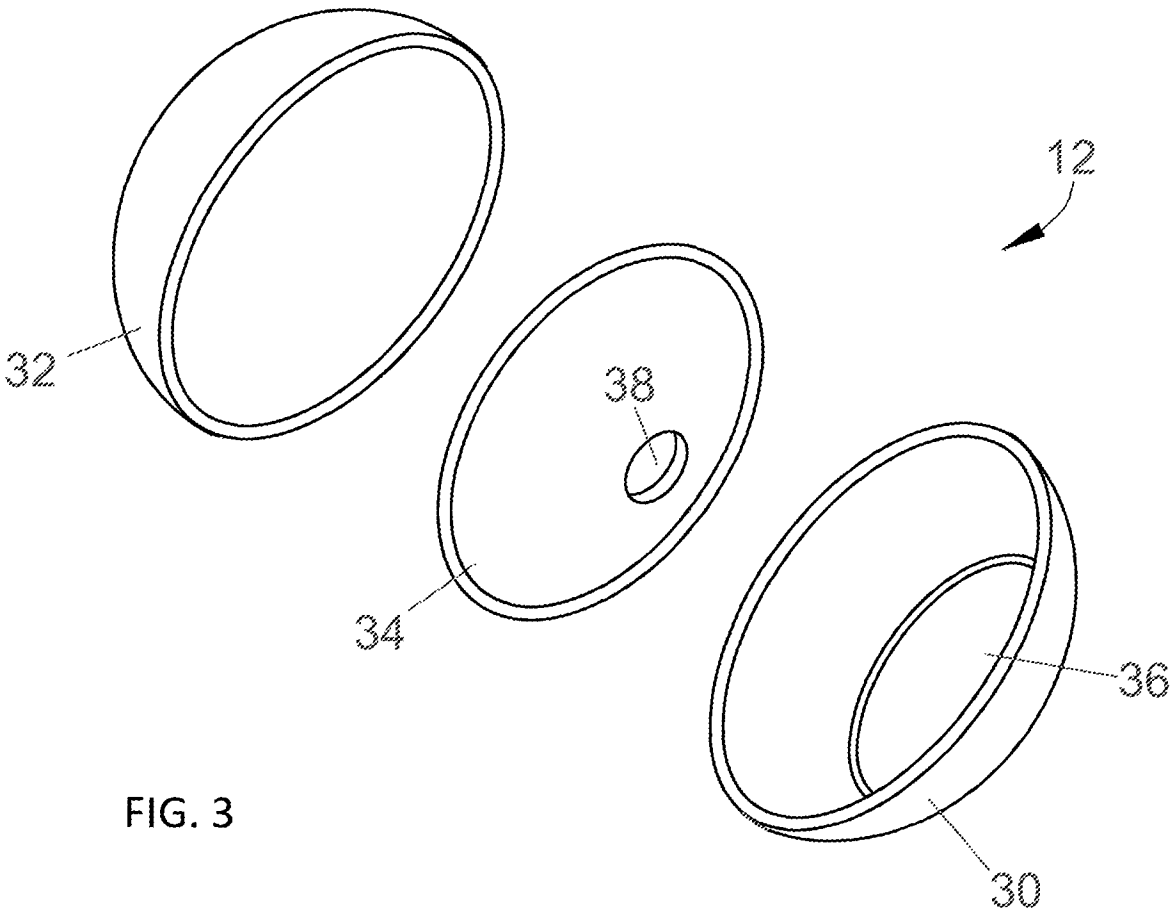
FIG. 3 represents certain components of the lighting unit of FIG. 1 that can be fabricated of the thermally-conducting translucent materials in accordance with nonlimiting embodiments of this invention.

FIG. 1 represents the enclosure 12 as having an ellipsoidal or spheroidal shape that promotes the capability of the lamp 10 to emit visible light therethrough in a nearly omnidirectional manner. FIG. 3 represents certain individual components of the enclosure 12. In particular, FIG. 3 represents the enclosure 12 as an assembly comprising translucent diffusers 30 and 32, each having a semi-elliptical or semispherical shape (hereinafter, semispherical, as a matter of convenience). The diffuser 30 is configured to be disposed between the base 16 and the other diffuser 32. FIG. 3 further depicts an internal reflector 34 adapted to be disposed between the diffusers 30 and 32, such that the reflector 34 is spaced apart from the base 16 and the LED device (e.g., 20) located in or near the base 16. The diffuser 30 has an opening 36 corresponding in size to a portion of the base 16 or its heatsink on which the PCB 26 and its LED device 20 can be mounted, such that visible light generated by the LED device 20 is directed through the opening 36 into the interior of the enclosure 12 defined by the diffusers 30 and 32. A portion of the generated light is reflected by the reflector 34 into the semispherical portion of the interior defined by the diffuser 30, through which the reflected light passes and is distributed to the environment surrounding the lamp 10. The remainder of the generated light passes through an opening 38 in the reflector 34 and enters the semispherical portion of the interior defined by the diffuser 32, through which the remaining light passes and is distributed to the environment surrounding the lamp 10. Materials commonly employed to produce certain components of the lamp 10, such as the enclosure 12, have included transparent and translucent polymeric materials, notable examples of which include polycarbonate (PC), polystyrene (PS), acrylics (for example, polymethyl methacrylate; PMMA), epoxies, silicones, polypropylene (PP), polyvinylidene fluoride (PVDF), and polyimides (nylon). For use in the enclosure 12 and its diffusers 30 and 32, these materials may contain a filler, for example, titania ($TiO_2$) to achieve a white diffusive appearance. For use in electrical appliances such as the lamp 10, these materials are also required to meet flame retardance standards, for example, UL (Underwriter Laboratories, Inc.) and CE (Conformité Européenne) standards.

In view of the above construction, it can be appreciated that visible light generated by the LED device 20 impinges and passes through portions of the diffusers 30 and 32, which are desired to have a diffusive optical effect to promote an omnidirectional lighting capability. Furthermore, visible light (and other electromagnetic wavelengths) generated by the LED device 20 subject components of the lamp, including the base 16, fins 18, PCB 26, and diffusers 30 and 32, to heat and flux (for example, ultraviolet (UV) and high-intensity blue flux). However, the diffusers 30 and 32 have traditionally played a limited role in dissipating heat from the lamp 10 as a result of being produced from optically translucent materials having relatively low thermal conductivities, for example, translucent polycarbonate materials having thermal conductivity coefficients of about 0.2 W/mK. The use of such traditional fillers capable of promoting thermal conductance, as well as more advanced fillers such as those disclosed in U.S. Patent Application Publication Nos. 2004/0190305 and 2012/0098425, have not been practical due to the negative effect on the optical properties required of the diffusers 30 and 32.

According to one aspect of the invention, at least a portion of the enclosure 12 of the lamp 10, for example, a portion of at least one of the diffusers 30 and 32, is produced from a composite material whose thermal conductivity is capable of significantly exceeding that of conventional materials of traditional diffusers (e.g., about 0.2 W/mK), yet retains a desirable level of translucence. Preferred composite materials comprise an optical grade transparent polymeric material as a matrix material, in which a fiber material is contained that promotes the thermal conductivity and also preferably an optical scattering effect and the optical translucence of the composite material relative to the polymeric matrix material.

Preferred matrix materials include, but are not limited to, transparent and translucent polymeric materials such PC, acrylics (for example, PMMA), epoxies, and silicones. The fiber material may be present in the composite material in the form of relative short Adiscontinuous@ fibers randomly dispersed in the polymeric matrix material, or may be longer Acontinuous@ fibers or tows (bundles of fibers) that may be straight or coiled and arranged to have a specific orientation. As examples, continuous individual fibers can be unidirectionally oriented within the matrix material, or can be braided or woven to form a fabric or other mat-like structures that can be laminated or otherwise embedded in the matrix material. Mat-like structures can be produced using conventional textile weave patterns, in which two or more sets of fiber tows ("warp" and "weft") are woven in a two-dimensional pattern, with the individual tows of each set passing over and under transverse tows of the other set or sets. The term "fiber material" will be used herein to refer to any such arrangement of fibers, and the term "individual fiber(s)" will be used herein to refer to fibers or tows which may be continuous or discontinuous and randomly dispersed in the matrix material, or may be continuous and oriented within the matrix material, or braided, or woven to form a mat-like structure that can be laminated or otherwise embedded in the matrix material.

Individual fibers utilized in the composite material preferably comprise a base or core material that predominantly determines the thermal conductivity of the fiber material, and an opaque diffusive white coating on their external surfaces that predominantly determines the optical properties of the fiber material. In particular, the core material of the individual fibers is preferably coated with a coating material that enables the surfaces of the individual fibers to have higher optical reflectivities than the core material, preferably reflectivities greater than 90%, for the purpose of promoting the translucent and optical scattering properties of the enclosure 12 and/or its individual diffusers 30 and 32.

Preferred core materials for the individual fibers include, but are not limited to, carbon-based materials such as pitch-derived carbon fibers, which are opaque to visible light and have thermal conductivities that can be in excess of 200 W/mK. A nonlimiting commercial example is Mitsubishi DIALEAD K13C6U, which is reported to have a thermal conductivity of 580 W/mK. As known in the art, pitch-derived carbon fibers are composed entirely or mostly of carbon atoms and can be produced from pitch that may be natural or manufactured, derived from petroleum, coal tar, or plants. Optimal diameters of the individual fibers may depend on whether the fiber material is a dispersion of individual fibers or in the form of oriented, braided, or woven structures fabricated of individual fibers.

Preferred coating materials include, but are not limited to, liquids and powders that can be applied by a variety of processes, depending on the nature of the material. As nonlimiting examples, the coating material may be a white liquid coating material that can be applied through spray coating, dip coating and flow coating techniques, or may be a dry white powder coating material that may be applied through electrostatic coating techniques, etc. The coating material may be intrinsically white, for example, polymers such as some fluoropolymers including PVDF, ETFE, PVDF, etc. Alternatively, the coating material may comprise a transparent binder, as examples, polymers such as some acrylics, silicones, epoxies, polyesters, etc., that may optionally contain one or more optical scatterers, as examples, $TiO_2$, $Al_2O_3$, and/or other optical scatterers having a refractive index that is sufficiently different from the binder to cause diffusive reflectance. A particular but nonlimiting example of a coating material is a dry white powder that contains titania particles in a cross-linkable polyester resin, an example of which is commercially available under the name Valspar PTW90135 from Valspar Corporation. The coating formed by a preferred coating material is opaque and is applied to sufficiently or completely encapsulate the individual fibers or resulting fiber material to contribute a diffusive white or near-white appearance to the individual fibers or fiber material and the composite material formed therewith. In addition, such coating materials have optical reflectivities of greater than 90% over a wavelength region of at least 350 nm to 800 nm, and can promote optical scattering of the composite material. Optimal thicknesses for the coatings on the individual fibers may depend on whether the fiber material is a dispersion of individual fibers or tows or in the form of oriented, braided, or woven structures fabricated of individual fibers or tows.

In addition to being reflective of visible light, the coated individual fibers or fiber material and composite materials formed therewith are preferably electrically insulating, stable at temperatures of at least 150° C. and more preferably at least 260° C., exhibit oxygen and humidity resistance, and do not absorb high-intensity near-UV/blue flux (wavelengths of 350 to 800 nm). The resulting composite material can also be capable of serving as a flame-retardant barrier attributable to the carbon fibers serving as an oxygen barrier, thereby promoting the ability of the lamp 10 to meet flame retardance standards, for example, the UL 94 standard for plastic materials. With such capabilities, the composite material may allow for the enclosure 12 and its diffusers 30 and 32 to be thinner than otherwise possible if these components were formed of solely of the polymer matrix material, for example, PC.

In preferred embodiments, the enclosure 12 and/or its diffusers 30 and 32 assist in conducting heat from the LED device 20 within the base 16 to the fins 18, from which the conducted heat can be dissipated to the surrounding environment. For example, forming the entire enclosure 12 of the composite material can significantly promote heat transfer and dissipation for the lamp 10. It should be understood that the composite material can be used to form other components of the lamp 10, for example, the base 16, fins 18, etc.

Investigations leading to the present invention indicated that a composite material formed of pitch-derived carbon fibers woven to form a fabric or mat and laminated or embedded in a matrix material of PC should have a fiber material loading of at least 0.01 volume percent, more preferably about 0.1 to about 5 volume percent, in order to have a significantly beneficial effect on the desired optical and thermal properties of the composite material. In addition, the coating thickness on the individual fibers or fiber material should be at least 1 micrometer and up to about 500 micrometers, more preferably about 50 to about 200 micrometers. To decrease the amount of fiber material required in the composite material to achieve a desired level of reflectivity through optical scattering, the composite material may further contain organic and/or inorganic fillers, for example, refractive index mismatched particles of titania ($TiO_2$), PTFE, etc. As such, the inclusion of additional materials within the composite material is also within the scope of this invention, whether for achieving or tailoring certain optical or thermal properties, or for any other purpose. Nonlimiting examples include sources of $Nd^{3+}$ ions.

While the invention has been described in terms of specific embodiments, it is apparent that other forms could be adopted by one skilled in the art. Therefore, the scope of the invention is to be limited only by the following claims.

The invention claimed is:

1. An LED-based lighting unit comprising:

an enclosure comprising a translucent diffuser portion;

at least one LED device adapted to emit visible light through the diffuser portion, the LED device generating thermal energy and being in thermal communication with the diffuser portion of the enclosure;

wherein the diffuser portion is formed of a composite material comprising a polymeric matrix material and a fiber material that contributes an optical scattering effect to the visible light passing through the diffuser portion of the enclosure, the polymeric matrix material is transparent or translucent to the visible light of the LED device and has a thermal conductivity, the fiber material causes the composite material to have a thermal conductivity greater than the thermal conductivity of the polymeric matrix material, the fiber material comprises individual fibers that each comprise a core material and an opaque diffusive white coating on an external surface thereof, the coating causes external surfaces of the individual fibers to have higher optical reflectivities than the core material, and the fiber material contributes to an optical scattering effect of the composite material and the diffuser portion formed thereof.

2. The LED-based lighting unit according to claim 1, wherein the core material has a thermal conductivity of greater than 200 W/mK.

3. The LED-based lighting unit according to claim 1, wherein the core material is a pitch-derived carbon.

4. The LED-based lighting unit according to claim 1, wherein the coating causes the optical reflectivities of the individual fibers to be greater than 90% over a wavelength region of at least 350 nm to 800 nm.

5. The LED-based lighting unit according to claim 1, wherein the fiber material comprises at least one of:

a random dispersion of a plurality of the individual fibers in the polymer matrix material;

an oriented plurality of the individual fibers in the polymer matrix material;

a braided plurality of the individual fibers in the polymer matrix material; and a woven plurality of the individual fibers in the polymer matrix material.

6. The LED-based lighting unit according to claim 1, wherein the matrix material is chosen from the group consisting of polycarbonates, polystyrenes, acrylics, epoxies, and silicones.

7. The LED-based lighting unit according to claim 1, wherein the coating completely encapsulates the individual fibers or the fiber material.

8. The LED-based lighting unit according to claim 1, wherein the diffuser conducts heat from the light LED device to fins adapted to dissipate the heat to an environment surrounding the lamp.

* * * * *